US008945343B2

(12) United States Patent
Wagner

(10) Patent No.: US 8,945,343 B2
(45) Date of Patent: Feb. 3, 2015

(54) DECAPSULATOR WITH APPLIED VOLTAGE FOR ETCHING PLASTIC-ENCAPSULATED DEVICES

(75) Inventor: Alan M. Wagner, Watsonville, CA (US)

(73) Assignee: Nisene Technology Group, Watsonville, CA (US)

( * ) Notice: Subject to any disclaimer, the term of this patent is extended or adjusted under 35 U.S.C. 154(b) by 11 days.

(21) Appl. No.: 13/619,489

(22) Filed: Sep. 14, 2012

(65) Prior Publication Data

US 2013/0082031 A1 Apr. 4, 2013

Related U.S. Application Data

(60) Provisional application No. 61/542,020, filed on Sep. 30, 2011.

(51) Int. Cl.

| | |
|---|---|
| ***C23F 1/08*** | (2006.01) |
| ***B44C 1/22*** | (2006.01) |
| ***C25F 3/00*** | (2006.01) |
| ***C25F 7/00*** | (2006.01) |

(52) U.S. Cl.
CPC .... *C25F 3/00* (2013.01); *C25F 7/00* (2013.01)
USPC ..... 156/345.47; 156/345.18; 205/640; 205/662; 204/494; 204/193; 204/428; 204/429; 204/434; 204/228.1

(58) Field of Classification Search
USPC ..... 134/902; 156/345.18, 345.47; 205/640, 205/642, 659, 662; 204/494, 193, 428, 429, 204/434, 228.1
See application file for complete search history.

(56) References Cited

U.S. PATENT DOCUMENTS

| | | | | |
|---|---|---|---|---|
| 4,344,809 | A * | 8/1982 | Wensink | 156/345.17 |
| 4,474,621 | A * | 10/1984 | Saccocio et al. | 134/1 |
| 5,766,496 | A | 6/1998 | Martin | |
| 5,792,305 | A * | 8/1998 | Winsemius et al. | 156/345.11 |
| 5,855,727 | A | 1/1999 | Martin et al. | |
| 6,350,110 | B1 | 2/2002 | Martin | |
| 6,723,656 | B2 | 4/2004 | Martin | |
| 7,981,698 | B2 * | 7/2011 | Pryputniewicz et al. | 438/4 |
| 2003/0006137 | A1 * | 1/2003 | Wei et al. | 204/280 |
| 2013/0082031 | A1 * | 4/2013 | Wagner | 216/95 |

* cited by examiner

*Primary Examiner* — Sylvia R MacArthur
(74) *Attorney, Agent, or Firm* — Van Pelt, Yi & James LLP

(57) ABSTRACT

An apparatus and a method for selectively etching an encapsulant forming a package of resinous material around an electronic device includes an electronic device package mountable on the etch head; a conductive electrode in electrical contact with package leads of the electronic device package to apply a first voltage to the package leads of the electronic device; a first pump configured to pump a first quantity of the etchant solution from the source into the etch head where the etchant solution is electrically biased to a second voltage different from the first voltage. An etch cavity is formed on an exterior surface of the electronic device package. When the etchant solution has etched through an exterior surface of the electronic device package, the conductive bond wires of the electronic device is prevented from being etched by the applied first voltage.

8 Claims, 3 Drawing Sheets

DECAPSULATOR WITH APPLIED VOLTAGE FOR ETCHING PLASTIC-ENCAPSULATED DEVICES

CROSS-REFERENCE TO RELATED APPLICATIONS

This application claims the benefit of U.S. Provisional Patent Application Ser. No. 61/542,020, filed on Sep. 30, 2011, which application is incorporated herein by reference in its entirety.

FIELD OF THE INVENTION

The invention relates to an apparatus and method for applying an etchant to a plastic encapsulated device and, in particular, to an apparatus and method for apply an etchant and an applied voltage to the plastic encapsulated device during the decapsulation process.

DESCRIPTION OF THE RELATED ART

Electronic devices with integrated circuit chips encapsulated in plastic packaging have been employed for some years. Typically, an epoxy resin is molded around the chip, a central portion of a lead frame and bonding wires or other connections between contact pads on the chip to inner lead fingers on the lead frame. It is sometimes necessary to decapsulate such as plastic-encapsulated package at least in part to allow for inspection, test and repair of the chip or the wire bonds to the chip, or the inner lead fingers, after the epoxy covering these elements is safely and effectively removed. In general, concentrated acids such as sulfuric and nitric acids or other solvents for the resin have been used in a decapsulation system for removing plastic material to expose the encapsulated chip or package elements.

U.S. Pat. No. 5,766,496 describes a decapsulation system for selectively etching an encapsulant of a plastic-encapsulated package. U.S. Pat. No. 6,350,110 B1 describes a multi-port metering pump which can be incorporated in a decapsulation system to deliver a very small volume of liquid to the etch head. A suitable decapsulation system should be capable of providing control of the amount of etching, preventing damage to the chip or package elements, and providing safety of use.

SUMMARY OF THE INVENTION

According to one embodiment of the present invention, an apparatus for selectively etching an encapsulant forming a package of resinous material around an electronic device includes a source of etchant solution; an etching assembly including an etch plate and a movable cover where the etch plate and the cover form an etch chamber; an etch head supported by the etch plate wherein an electronic device package is mountable in the chamber on the etch head; a conductive electrode in electrical contact with package leads of the electronic device package to apply a first voltage to the package leads of the electronic device; a first pump configured to pump a first quantity of the etchant solution from the source into the etch head where the etchant solution is electrically biased to a second voltage different from the first voltage. In operation, an etch cavity is formed on an exterior surface of the electronic device package by reaction of the etchant solution with the resinous material, and when the etchant solution has etched through an exterior surface of the electronic device package, the conductive bond wires of the electronic device is prevented from being etched by the applied first voltage.

According to another aspect of the present invention, a method of decapsulating a plastic package of resinous material around an electronic device includes: providing a source of etchant solution and an etching assembly including an etch plate and a movable cover, and an etch head in flow connection to the source of etchant solution; positioning an electronic device package of resinous material on the etch head; applying a first voltage to the package leads of the electronic device; pumping a volume of etchant solution from the source of etchant solution to the etch head; electrically biasing the etching solution to a second voltage different than the first voltage; and etching the resinous material by reaction of the etchant solution with the resinous material to form an etch cavity in the electronic device package. In operation, when the etchant solution has etched through an exterior surface of the electronic device package, the conductive bond wires of the electronic device is prevented from being etched by the applied first voltage.

The present invention is better understood upon consideration of the detailed description below and the accompanying drawings.

DETAILED DESCRIPTION OF THE PREFERRED EMBODIMENTS

In accordance with the principles of the present invention, a decapsulation system and method applies a bias voltage to a plastic encapsulated electronic device under etch. The applied voltage has the effect of protecting the conductive bond wires of the electronic device from damages during the etch process. In embodiments of the present invention, the decapsulation system and method is applied to plastic encapsulated electronic devices constructed using conductive bond wires made of materials other than gold.

In the present description, an electronic device refers to a packaged semiconductor device incorporating one or more integrated circuit chips. Although an electronic device may be packaged in a variety of ways using different types of encapsulation materials, the present description is concerned with electronic devices that are encapsulated in plastic packaging or other types of resinous materials. That is, the electronic device includes plastic encapsulation covering at least the chip(s), a central portion of a lead frame and bond wires connecting the chip(s) to the lead frame. Bond wires are made of various conductive materials, with copper bond wires and gold bond wires being most commonly used. The electronic device also includes leads or lead fingers projecting out of the plastic encapsulation where the leads or lead fingers are used to form electrical connections from the outside world to the integrated circuit chips encapsulated therein.

In embodiments of the present invention, the basic structure of the decapsulation system is constructed based on the decapsulation system described in aforementioned U.S. Pat. No. 5,766,496 and may incorporate the multi-port metering pump described in U.S. Pat. No. 6,350,110 B1. However, the decapsulation system of the present invention incorporates enhancements over the aforementioned decapsulation systems by providing an applied voltage to the electronic device under etch. The decapsulation system and method in accordance with embodiments of the present invention will be described with reference to FIGS. 1 and 2.

Figure 1:
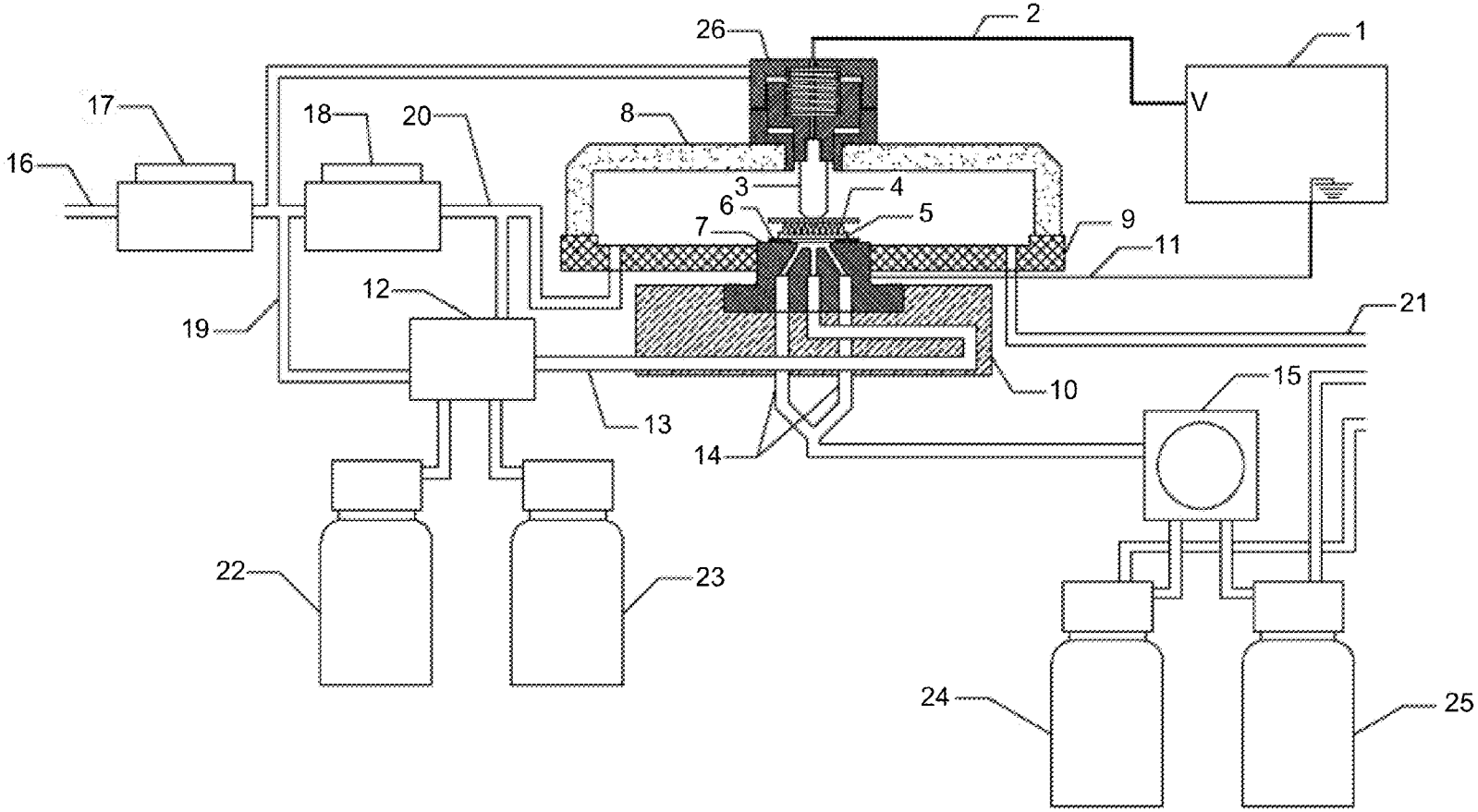
FIG. 1 is a schematic side view of a decapsulation system according to one embodiment of the present invention.
Figure 2:
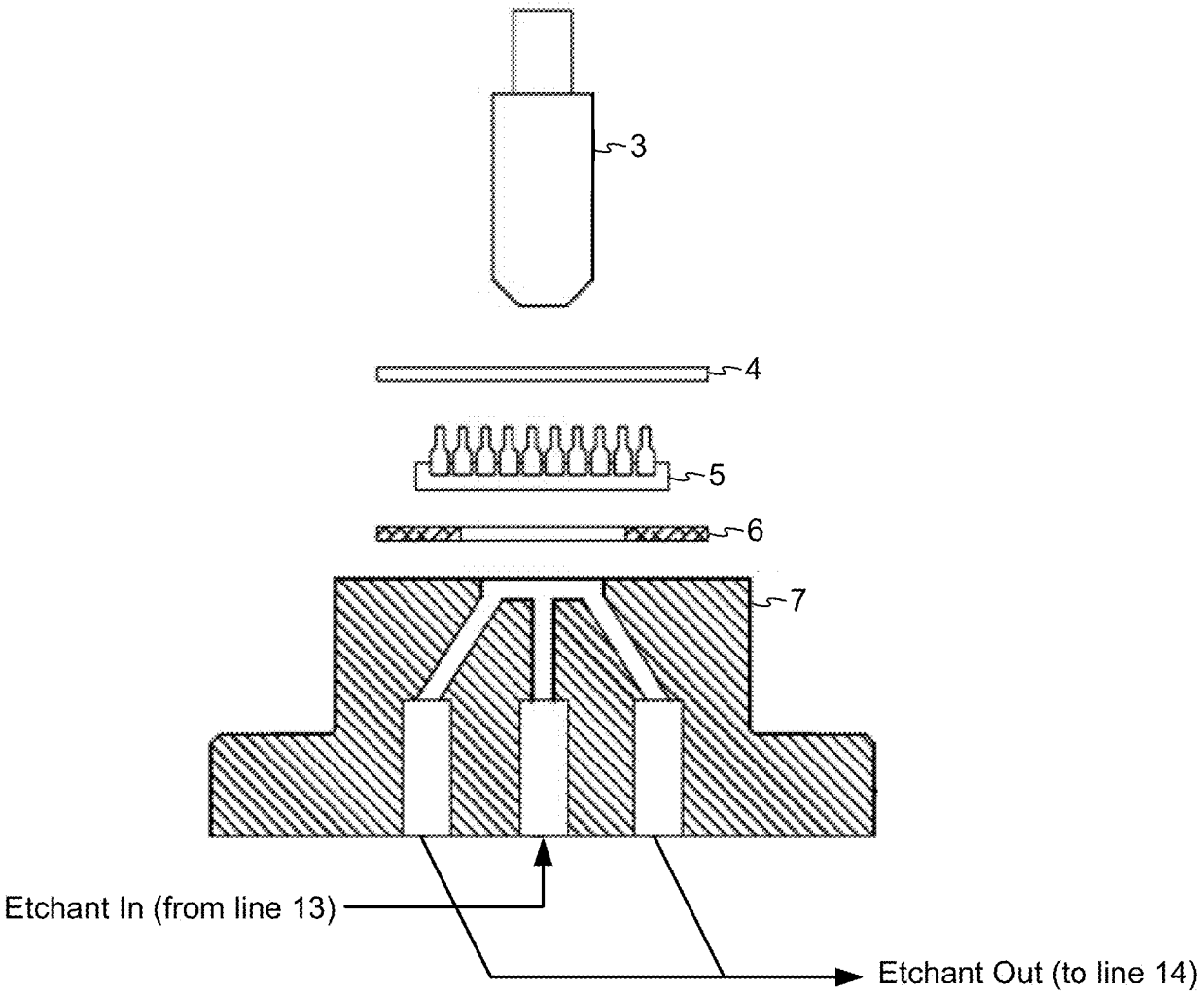
FIG. 2 is an exploded side view of the etch head portion of the decapsulation system of FIG. 1.

FIG. 1 is a schematic side view of a decapsulation system according to one embodiment of the present invention. FIG. 2 is an exploded side view of the etch head portion of the decapsulation system of FIG. 1. Referring to FIGS. 1 and 2, a micro-metering multi-port pump 12 draws an etchant mixture from two etchant supply bottles 22, 23 and pumps the etchant mixture into an etchant supply line 13. The pump 12 is actuated by dry nitrogen at high pressure (e.g. ~70 PSI). The pressure is controlled by a high-pressure regulator 17 receiving a source of dry nitrogen on a dry nitrogen supply line 16.

As the etchant mixture is pumped through the etchant supply line 13, the etchant mixture travels through the spirally passageway in the core of a heat exchanger 10. The heat exchanger 10 adjusts the temperature of the etchant mixture to a desired etching temperature. In some embodiments, the heat exchanger 10 may also adjust the temperature of the etch head 7 and, through a gasket 6 that defines the decapsulation aperture, the plastic encapsulated electronic device 5 to be etched (henceforth referred to as the "sample") to the etching temperature. In embodiments of the present invention, the heat exchanger 10 may be operated to heat or cool the etchant mixture. That is, the heat exchanger 10 may be operated to increase or decrease the etching temperature of the etchant mixture, such as to increase above or decrease below the ambient temperature. Furthermore, the heat exchanger 10 may be operated to heat or cool the etch head and at least the surface of the device under etch mounted on the etch head.

The conductive leads protruding from the sample's encapsulant are pressed up against a metal backing plate 4. This combination of sample 5 and the metal backing plate 4 is held in place over the etch head 7 and the aperture-defining gasket 6 by a metal ram-nose 3. The metal ram-nose 3 is connected to a moveable safety cover 8 and a cover-arm assembly 26.

When high pressure is applied to the cover-arm assembly 26 through a high-pressure supply line 19 from the high-pressure regulator 17, the safety cover 8 presses down on an etch plate 9, forming the etch chamber. Meanwhile, the ram-nose 3 presses down on the metal backing plate 4, creating a seal between the sample 5 and the etch head 7 through the gasket 6. Also, the etch chamber is pressurized with low-pressure nitrogen (e.g. ~5 PSI) by a low-pressure supply line 20 from a low-pressure regulator 18. The low-pressure nitrogen in the etch chamber vents to an etch chamber vent line 21.

In embodiments of the present invention, the metal ram-nose 3 is supplied with a voltage from an adjustable power supply 1. More specifically, the metal ram-nose 3 is connected to a positive node 2 of the power supply 1. While etching, this voltage travels through the ram-nose 3 to the metal backing plate 4 to the sample 5, which provides the bond wires of the device under etch 5 with a positive electrical bias. Meanwhile, the etch head 7 is connected through a wire to the negative terminal 11 of the adjustable power supply 1. The negative terminal of the power supply 1 can be connected to a negative voltage potential but is typically at ground. The etch head 7 is thus electrically biased to the ground potential. Accordingly, the etchant mixture is electrically biased to the ground potential as well. In the present embodiment, the etch head 7 is grounded to bias the etchant mixture to the ground potential. In other embodiments, other methods to apply ground potential to the etchant mixtures may be used, such as by use of a conductive electrode coated with a non-conductive material.

As the etchant mixture is pumped through the heat exchanger 10 and the etch head 7, the etchant mixture contacts the sample 5 through the gasket 6 and etches a cavity in the encapsulant of the sample. The etched encapsulant and waste acid leave the etch chamber through an etchant waste line 14 and are collected in etchant waste bottles 24, 25. The waste diverter valve 15 dictates which waste bottle the etchant waste is collected in.

As the etch cavity grows larger, the bond wires in the sample 5 will become exposed. The bond wires are biased to the positive voltage of the power supply 1 through the electrical connection formed by the ram-nose 3, the metal backing plate 4, the leads or lead fingers of the package, to the package lead frame and onto the bond wires. The etchant mixture contains ions, so when the etchant mixture contacts the bond wires, an electrochemical cell is formed in the etch cavity between the adjustable power supply 1 and the etch head 7, which is grounded to the negative terminal 11 of the adjustable power supply 1. The positively-charged bond wires repel positively-charged ions in the etchant mixture and attract negatively-charged ions in the etchant mixture. As a result, an electrolysis process occurs in the electrochemical cell where the electrolysis process is exploited to protect the bond wires made of certain materials from etch damages, as will be explained in more detail below.

When the sample is fully etched, a rinse pumping cycle occurs for 0-20 seconds, then the pump 12, the etchant supply line 13, the etch cavity, and the etchant waste line 14 are cleared of etchant by a purge of low-pressure nitrogen (e.g. ~5 PSI) from the low-pressure regulator 18 through the low-pressure supply line 20. After the system is purged of etchant, the etch chamber can be opened, allowing the user to remove the sample 5 for manual cleaning and inspection.

The amount of time spent etching depends on the size of the sample and amount of encapsulant to be removed during etching. Parameters such as heat-up/cool-down time, etch time, etch temperature, etchant volume, rinse time, and etchant mixture ratio can be set by the user through the decapsulation system's programming control. The etch process can be managed by a multi-controller, which in turn manages the local controllers for the pump 12, the valve manifolds of the decapsulation system, and the heaters in the heat exchanger 10.

The decapsulation system and method of the present invention employs an applied voltage to bias the conductive bond wires of an electronic device under etch to a positive potential. The electrolysis process thus formed in the etch cavity has the beneficial effect of forming a protective coating on bond wires of certain materials, for example, copper bond wires. Therefore, the decapsulation system and method of the present invention may be advantageously applied to allow an electronic device using copper bond wires to be decapsulated without damages to the copper bond wires. In some cases, the electrolysis process thus formed in the etch cavity may have an adverse effect on bond wires of other materials, such as gold bond wires. In embodiments of the present invention, the decapsulation system and method is configured to selectively apply the bias voltage during the decapsulation process. Accordingly, the same decapsulation system and method may be readily used for electronic devices incorporating different bond wire materials. When applied voltage is not needed, the decapsulation system may turn off or disconnect the applied voltage to the device under etch. When applied voltage can be used to protect the bond wires, the decapsulation system applies the bias voltage as described above.

Figure 3:
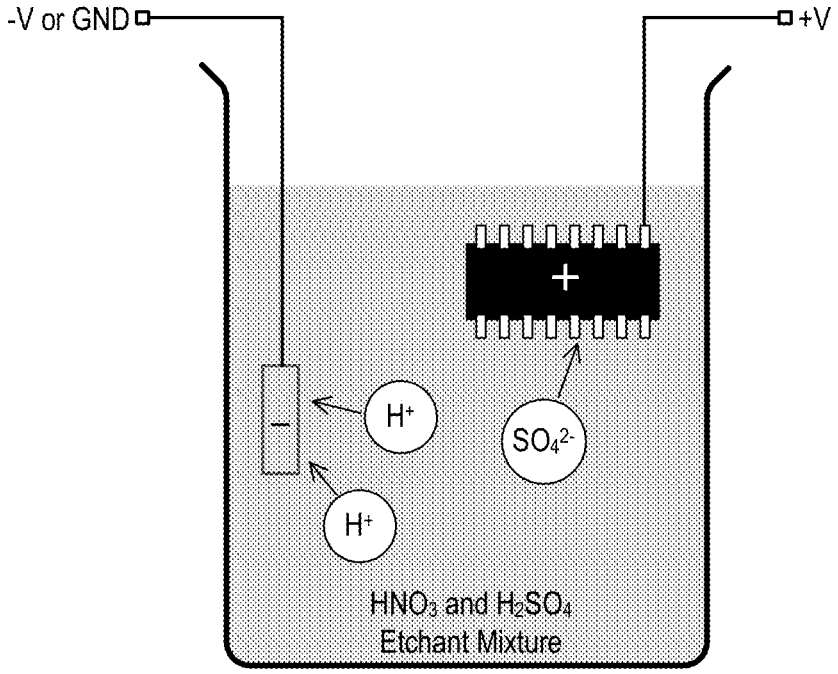
FIG. 3 is a diagram illustrating the electrochemical cell being formed in the etch cavity during the etching process as the result of the applied voltage of the decapsulation system.

FIG. 3 is a diagram illustrating the electrochemical cell being formed in the etch cavity during the etching process as the result of the applied voltage of the decapsulation system. FIG. 3 depicts the process in a beaker, but the principle is the same for use in the decapsulation system. In the present illustration, the etchant mixture is made of nitric acid ($HNO_3$) and sulfuric acid ($H_2SO_4$), anhydrous or fuming sulfuric acid. In the electrochemical cell, a positive voltage is applied to the bond wires of the sample under etch while the etchant mixture is biased to a negative voltage or the ground potential. Accordingly, the metal bond wires repel the acid ions ($H^+$) in the etchant solution so that the bond wires are not etched. Meanwhile, the acid ions are free to etch the neutral (not positive or negative charged) encapsulant of the sample. The side effect of this process is that the bond wires attract the negatively charged sulfate ions ($SO_4^{2-}$). The sulfate ions form a thin layer of copper sulfate onto the bond wires. This sulfate salt protects the bond wires and can later be removed by a manual rinse.

In the above described embodiments, the electronic device under etch is shown as a plastic dual in-line (PDIP) package with package leads extending from the plastic encapsulation. The metal backing plate is constructed as a sheet of metal to make electrical contact with the exposed lead of the PDIP package for applying the voltage to the bond wires. In other embodiments, the metal backing plate may be configured in other forms suitable for other plastic encapsulated package types, such as ball grid arrays (BGAs), plastic leaded chip carrier (PLCC), plastic quad flat pack (PQFP), small-outline integrated circuit (SOIC), and others. In embodiments of the present invention, the metal backing plate is configured as a conductive electrode for electrically contacting the leads of the device under etch, regardless of the package type.

The above detailed descriptions are provided to illustrate specific embodiments of the present invention and are not intended to be limiting. Numerous modifications and variations within the scope of the present invention are possible. For example, in the above-described decapsulation system, a metal backing plate, a ram nose are used to couple the applied voltage to the device under etch. The specific construction of the elements for coupling the applied voltage to the device under etch is not critical to the practice of the present invention and one of ordinary skill in the art would appreciate that other elements can be used to electrically couple an applied voltage to a device under etch in a decapsulation system. Also, in the above-described embodiments, an aperture-defining gasket is used to define the decapsulation aperture. The aperture-defining gasket is optional and may be omitted in other embodiments of the present invention.

Furthermore, in the above described embodiments, the adjustable power supply provides a positive bias voltage to the device under etch. In other embodiments, the adjustable power supply may provide a negative bias voltage to the device under etch. The use of a positive or a negative applied bias voltage may be determined based on the bond wire materials and the etchant chemistry being used. Furthermore, in embodiments of the present invention, the adjustable power supply 1 is configured to provide different voltage values for biasing the bond wires of the sample under etch. The voltage values may be selected based on the bond wire materials and the etchant chemistry being used.

I claim:

1. An apparatus for selectively etching an encapsulant forming a package of resinous material around an electronic device comprising:

a source of etchant solution;

an etching assembly including an etch plate and a movable cover, the etch plate and the cover forming an etch chamber;

an etch head supported by the etch plate and electrically connected to a second voltage, wherein an electronic device package is mountable in the chamber on a top surface of the etch head;

a conductive electrode in electrical contact with package leads of the electronic device package to apply a first voltage to the package leads of the electronic device, wherein the first voltage is a positive voltage and the second voltage is a negative voltage or the ground potential;

a first pump configured to pump a first quantity of the etchant solution from the source into the etch head, the etchant solution being electrically biased to the second voltage by the etch head being electrically connected to the second voltage, wherein, in response to an electronic device package being mounted on the top surface of the etch head, the etch head is configured to form a seal between the electronic device package and the top surface of the etch head, and the first pump is configured to pump the first quantity of the etchant solution into the etch head and onto the top surface of the etch head to cause the etchant solution to contact the electronic device package mounted thereon, the etchant solution reacting with the resinous material forming the package of the electronic device to form an etch cavity on the exterior surface of the electronic device package and exposing the conductive bond wires of the electronic device where the conductive bond wires of the electronic device are prevented from being etched by the applied first voltage.

2. The apparatus of claim 1, further comprising a power supply providing the first voltage to the conductive electrode and the second voltage to the etch head, the first voltage being a positive voltage and the second voltage being a ground potential, the first voltage being selected based on the material of the bone wire used in the electronic device package and the etchant solution being used.

3. The apparatus of claim 1, wherein the conductive electrode comprises a metal backing plate and the apparatus further comprises a conductive ram-nose configured to press down on the metal backing plate when the cover engages the etch plate to form the etch chamber, and the metal backing plate in turn engages the electronic device package to form a seal between the encapsulant of the electronic device and the etch head.

4. The apparatus of claim 3, wherein the first voltage is applied to the package leads of the electronic device package through the ram-nose and through the metal backing plate.

5. The apparatus of claim 3, further comprising a gasket positioned on the etch head to define a decapsulation aperture, the electronic device package being mountable on the gasket.

6. The apparatus of claim 1, wherein the conductive bond wires comprises copper bond wires.

7. The apparatus of claim 1, further comprising a heat exchanger in flow connection with the source of etchant solution and the etch head, the heat exchanger being configured to adjust the temperature of the etchant solution flowing through the heat exchanger to the etch head.

8. The apparatus of claim 7, wherein the heat exchanger is further configured to adjust the temperature of the etch head and at least the surface of the electronic device package mounted on the etch head.

* * * * *